US011035333B1

(12) United States Patent
Wiebrecht et al.

(10) Patent No.: US 11,035,333 B1
(45) Date of Patent: Jun. 15, 2021

(54) DUCT ASSEMBLY FOR FUEL INJECTION SYSTEMS IN ENGINES

(71) Applicant: Caterpillar Inc., Peoria, IL (US)

(72) Inventors: Eric D. Wiebrecht, Germantown Hills, IL (US); Kenth I Svensson, Peoria, IL (US); Marchione T. Andre, Heber City, UT (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/011,136

(22) Filed: Sep. 3, 2020

(51) Int. Cl.

| | |
|---|---|
| ***F02B 3/00*** | (2006.01) |
| ***F02M 55/00*** | (2006.01) |
| ***F02M 61/14*** | (2006.01) |
| ***F02F 1/24*** | (2006.01) |
| ***F02F 3/28*** | (2006.01) |
| ***F02F 1/18*** | (2006.01) |

(52) U.S. Cl.
CPC ..... *F02M 55/008* (2013.01); *F02F 1/18* (2013.01); *F02F 1/24* (2013.01); *F02F 3/28* (2013.01); *F02M 61/14* (2013.01)

(58) Field of Classification Search
CPC ..... F02M 61/1806; F02M 61/14; F02M 61/1813; F02M 61/182; F02B 23/0651
USPC ..... 123/294
See application file for complete search history.

(56) References Cited

U.S. PATENT DOCUMENTS

| | | | | |
|---|---|---|---|---|
| 8,967,129 | B2 | 3/2015 | Mueller | |
| 10,012,196 | B1 * | 7/2018 | Qi | F02B 23/0651 |
| 10,036,356 | B2 * | 7/2018 | Svensson | F02M 61/1833 |
| 10,151,235 | B2 | 12/2018 | Anders et al. | |
| 10,161,626 | B2 | 12/2018 | Mueller | |
| 10,428,781 | B2 | 10/2019 | Mahato et al. | |
| 10,711,752 | B2 * | 7/2020 | Martin | F02B 23/00 |
| 2016/0298531 | A1 * | 10/2016 | Anders | F02B 23/00 |
| 2017/0114998 | A1 * | 4/2017 | Mueller | F23D 11/383 |
| 2018/0258836 | A1 * | 9/2018 | Anders | F02M 61/166 |
| 2019/0063391 | A1 | 2/2019 | Martin et al. | |
| 2020/0191045 | A1 * | 6/2020 | Gubba | B01F 5/0603 |

FOREIGN PATENT DOCUMENTS

| | | |
|---|---|---|
| GB | 2467321 | 8/2010 |

* cited by examiner

*Primary Examiner* — Long T Tran
*Assistant Examiner* — James J Kim

(57) ABSTRACT

A duct assembly for a fuel injector of an engine includes a base and multiple duct bodies. The base includes a number of spaced apart receptacles. Each receptacle defines a cavity with a receptacle axis, a rotational engagement surface, and an axial engagement surface. The duct bodies are correspondingly secured within the cavities. Each duct body defines an axis and a duct extending along the axis to provide a passage for a fuel jet from the fuel injector. Each duct body defines an axial alignment surface engaging the axial engagement surface of the receptacle in which it is disposed to axially align the duct body along the receptacle axis of the corresponding receptacle.

20 Claims, 13 Drawing Sheets

DUCT ASSEMBLY FOR FUEL INJECTION SYSTEMS IN ENGINES

TECHNICAL FIELD

The present disclosure relates to a fuel injection system for an internal combustion engine. More particularly, the present disclosure relates to a duct assembly for the fuel injector system.

BACKGROUND

In internal combustion engines, a combustion chamber is commonly defined between a cylinder head and a piston. In some applications, fuel for combustion is injected as a fuel jet into the combustion chamber by, for example, a fuel injector. Fuel injectors typically include orifices through which a quantity of fuel may pass through to be injected and introduced into the combustion chamber. A manner in which the injected fuel mixes and/or interacts with air and other environmental elements of the combustion chamber may impact the combustion process and emissions. The manner in which the fuel jet is injected may impact or affect the amount of soot formation within the combustion chamber.

Duct structures may be provided in combustion engines to control the mixing of the fuel jets, delay ignition, and reduce soot formation within the combustion chamber. A duct structure may include multiple ducts arranged (e.g., in the form of a circular array) around the fuel injector such that the ducts may receive corresponding fuel jets from corresponding orifices of the fuel injector. The ducts control an interaction and/or mixing of the fuel jets, which in turn, may reduce the amount of soot formed in the combustion chamber. To attain such interaction and/or mixing of the fuel jets, the ducts should possess a desired geometry and need to be deployed at an optimum angle with respect to the fuel jets. Attaining such geometry and angle of the ducts is difficult and requires complex manufacturing processes, and such difficulty is exacerbated if an increased number of ducts were required around the fuel injector.

U.S. Pat. No. 8,967,129 relates to an internal combustion engine that includes an engine block having a cylinder bore and a cylinder head having a flame deck surface disposed at one end of the cylinder bore. A piston within the cylinder bore has a piston crown portion facing the flame deck surface to define a combustion chamber therebetween. A fuel injector is configured to inject a fuel jet into the combustion chamber along a fuel jet centerline. A duct is defined in the combustion chamber between the piston crown and the flame deck surface that has a generally rectangular cross section and extends in a radial direction relative to the cylinder bore substantially along the fuel jet centerline.

SUMMARY OF THE INVENTION

In one aspect, the disclosure is directed to a duct assembly for a fuel injector of an engine. The duct assembly includes a base and multiple duct bodies. The base is configured to be coupled to a cylinder head of the engine and includes a number of spaced apart receptacles. Each receptacle defines a cavity that in turn defines a receptacle axis, a rotational engagement surface, and an axial engagement surface. The duct bodies are correspondingly secured within cavities defined by the spaced apart receptacles. Each duct body defines an axis and a duct extending therethrough along the axis to provide a passage for a corresponding fuel jet discharged from the fuel injector. Each duct body defines an axial alignment surface engaging the axial engagement surface of the receptacle in which it is disposed to axially align the duct body along the receptacle axis of the corresponding receptacle.

In another aspect, the disclosure is related to a fuel injection system for an engine. The fuel injection system includes a fuel injector configured to discharge fuel jets into a combustion chamber of the engine. The fuel injection system also includes a duct assembly for the fuel injector. The duct assembly includes a base and multiple duct bodies. The base is configured to be coupled to a cylinder head of the engine and includes a number of spaced apart receptacles. Each receptacle defines a cavity that in turn defines a receptacle axis, a rotational engagement surface, and an axial engagement surface. The duct bodies are correspondingly secured within cavities defined by the spaced apart receptacles. Each duct body defines an axis and a duct extending therethrough along the axis to provide a passage for a corresponding fuel jet discharged from the fuel injector. Each duct body defines an axial alignment surface engaging the axial engagement surface of the receptacle in which it is disposed to axially align the duct body along the receptacle axis of the corresponding receptacle.

In yet another aspect, the disclosure is directed to an engine. The engine includes a cylinder defining a bore, a piston slidably disposed within the bore and defining a piston crown, a cylinder head coupled to the cylinder and defining a flame deck surface, and a combustion chamber defined between the flame deck surface and the piston crown. The engine further includes a fuel injector and a duct assembly for the fuel injector. The fuel injector is configured to discharge fuel jets into the combustion chamber. The duct assembly includes a base and multiple duct bodies. The base is coupled to the cylinder head and includes a number of spaced apart receptacles. Each receptacle defines a cavity that in turn defines a receptacle axis, a rotational engagement surface, and an axial engagement surface. The duct bodies are correspondingly secured within cavities defined by the spaced apart receptacles. Each duct body defines an axis and a duct extending therethrough along the axis to provide a passage for a corresponding fuel jet discharged from the fuel injector. Each duct body defines an axial alignment surface engaging the axial engagement surface of the receptacle in which it is disposed to axially align the duct body along the receptacle axis of the corresponding receptacle.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts. Also, wherever possible, same reference numbers will be used throughout the drawings to refer to the same or the like parts.

Figure 1:
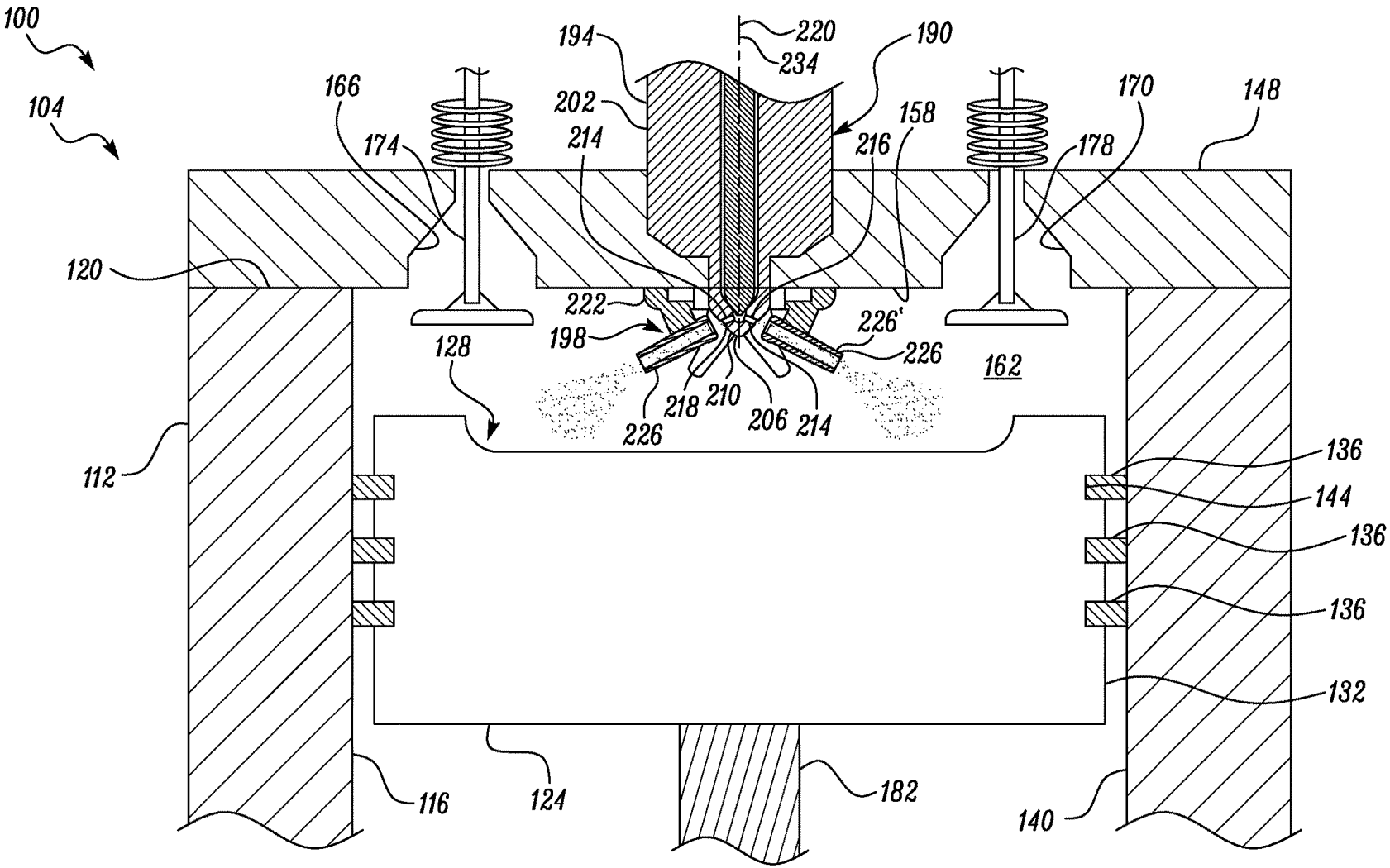
FIG. 1 a sectional view of an engine including a fuel injection system, in accordance with an aspect of the present disclosure.

Referring to FIG. 1, an engine 100 is shown. The engine 100 may be an internal combustion engine 104 and may include any of a diesel engine, a gasoline engine, a gas engine, a two-stroke engine, a four-stroke engine, a dual fuel engine, or any other similar internal combustion engine known in the art. The engine 100 may be used in any application including construction and mining machines, such as excavators, shovels, loaders, off-highway trucks, dozers, as well as stationary power generation units and marine vessels.

The engine 100 includes a cylinder 112 that defines a bore 116. The bore 116 extends from an end 120 (e.g., an upper end) of the cylinder 112 to another end (e.g., a lower end) (not shown) of the cylinder 112. The engine 100 includes a piston 124 that is slidably disposed within the bore 116. The piston 124 may be configured to reciprocate within the bore 116 between a top dead center (TDC) and a bottom dead center (BDC). Further, the piston 124 defines a piston crown 128 (which may include a bowl portion, for example) and may also define other features, such as a piston skirt 132. The piston skirt 132 may define a number of grooves (only one groove 144 is annotated) to receive piston rings 136 that may interact with a cylinder wall 140 defining the bore 116.

The engine 100 also includes a cylinder head 148 that is coupled to the end 120 of the cylinder 112. The cylinder head 148 defines a flame deck surface 158 that, upon assembly of the cylinder head 148 to the end 120, may face the piston crown 128. A combustion chamber 162 of the engine 100 is defined between the flame deck surface 158 and the piston crown 128. In other words, the combustion chamber 162 is bound and/or delimited at one end by the flame deck surface 158 of the cylinder head 148, and bound and/or delimited at another end by the piston crown 128 of the piston 124. The combustion chamber 162 is also bound and/or delimited by a portion of the cylinder wall 140 that defines the bore 116.

Further, the cylinder head 148 includes one or more intake conduits (e.g., intake conduit 166) and one or more exhaust conduits (e.g., exhaust conduit 170). The intake conduits facilitate an intake of charge (that may include one or more of air, exhaust gas, natural gas, or other fuels) into the combustion chamber 162, while the exhaust conduits facilitate a discharge or exit of exhaust gases from the combustion chamber 162. One or more intake valves (e.g., intake valve 174) may be provided to regulate an influx of the charge into the combustion chamber 162 through the intake conduits, and, similarly, one or more exhaust valves (e.g., exhaust valve 178) may be provided to regulate discharge or exit of exhaust gases of combustion from the combustion chamber 162 through the exhaust conduits.

The engine 100 also includes a connecting rod 182. The connecting rod 182 is coupled to the piston 124 to move and reciprocate as the piston 124 moves and reciprocates between the TDC and BDC. The connecting rod 182 may also be coupled to a crankshaft (not shown) at one end to power a rotation of the crank shaft, and, in turn by which output (e.g., rotary power output) may be generated by the engine 100. Although the above aspects are discussed with respect to a single cylinder (i.e., cylinder 112) the engine 100 may include multiple cylinders, and to each of which discussions ascribed to the cylinder 112 may be equivalently and appropriately applied.

With continued reference to FIG. 1, the engine 100 includes a fuel injection system 190. The fuel injection system 190 includes a fuel injector 194 and a duct assembly 198 for the fuel injector 194.

The fuel injector 194 is configured to inject fuel into the combustion chamber 162 during engine operations. The fuel injector 194 includes an injector body 202 with a tip portion 206 disposed at an end 210 of the injector body 202, as shown. The fuel injector 194 may be mounted to the cylinder head 148 and may pass through the cylinder head 148 such that the tip portion 206 of the injector body 202 may protrude and extend into the combustion chamber 162. In that manner, the combustion chamber 162 may be in fluid communication with the tip portion 206 of the fuel injector 194 and may receive fuel from the fuel injector 194. The tip portion 206 includes a number of orifices 214 (six orifices according to an exemplary embodiment of the present disclosure out of which only two orifices, i.e., orifice 216 and orifice 218 are shown). Fuel may pass through the injector body 202 and exit the orifices as fuel jets that are introduced into the combustion chamber 162 for combustion. The orifices 214 may be higher or a lower in number than the six referenced above. Further, the orifices 214 may be arrayed around a longitudinal axis 220 of the fuel injector 194, as shown.

Figure 2:
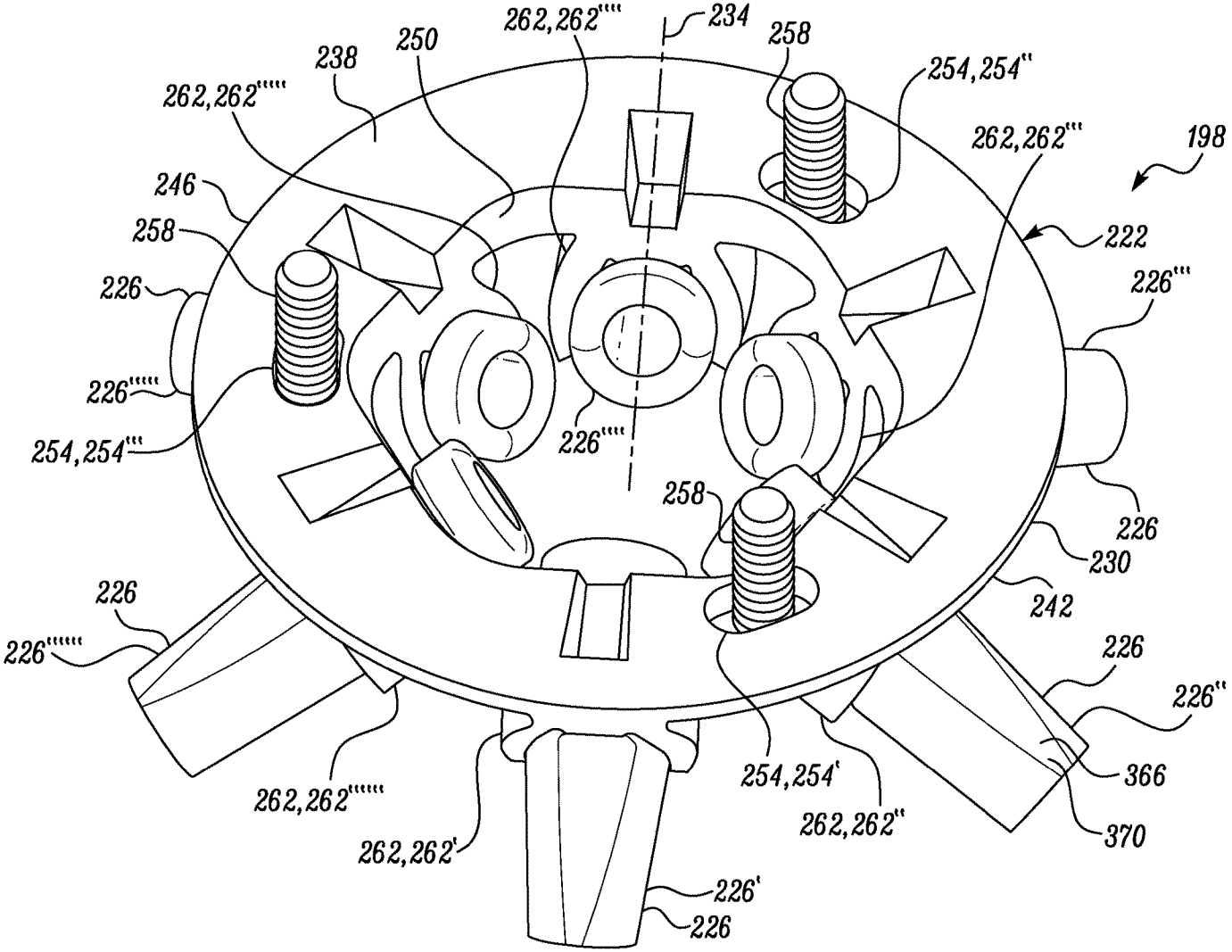
FIG. 2 is a perspective view of a duct assembly associated with a fuel injector of the fuel injection system, in accordance with an aspect of the present disclosure.
Figure 3:
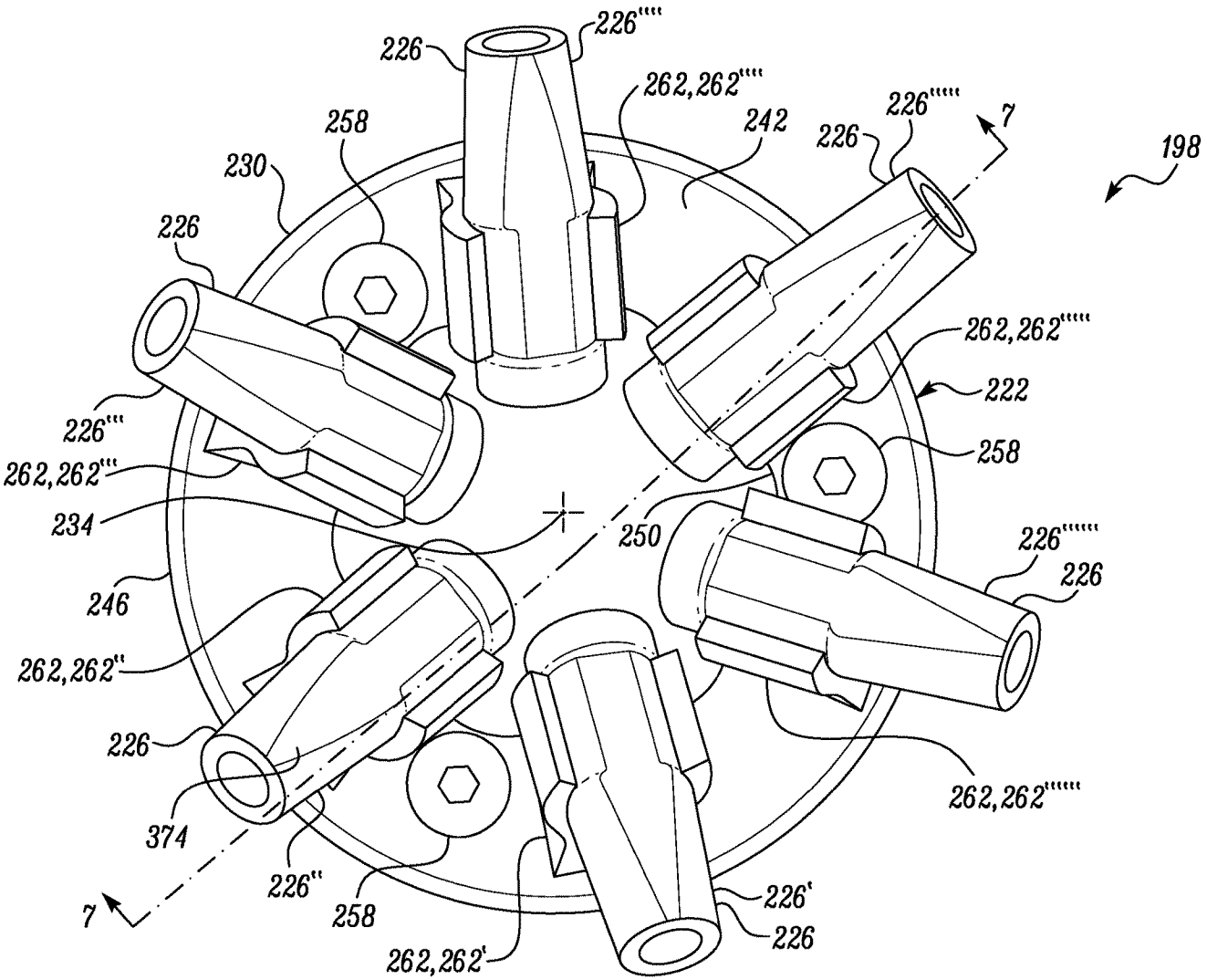
FIG. 3 is a bottom view of the duct assembly including a base and a number of duct bodies secured to a corresponding number of receptacles of the base, in accordance with an aspect of the present disclosure.

Referring to FIGS. 1, 2, and 3, the duct assembly 198 is configured to control the mixing of the fuel jets to reduce soot formation within the combustion chamber 162. In this regard, the duct assembly 198 includes a base 222 and multiple duct bodies 226', 226", 226''', 226'''', 226''''', 226'''''' (collectively, duct bodies 226), as shown. The duct assembly 198 is configured to be positioned with respect to the fuel injector 194 such that the duct bodies 226 are arrayed around the tip portion 206 with the duct bodies 226 being correspondingly aligned with respect to the orifices 214 of the fuel injector 194 disposed at the tip portion 206 (e.g., see duct body 226' aligning with respect to orifice 216 in FIG. 1). In so doing, the duct bodies 226 receive the fuel jets from the corresponding orifices 214 and facilitate the mixing of the fuel jets for facilitating combustion. Further details with regard to the duct assembly 198 are discussed below.

Figure 4:
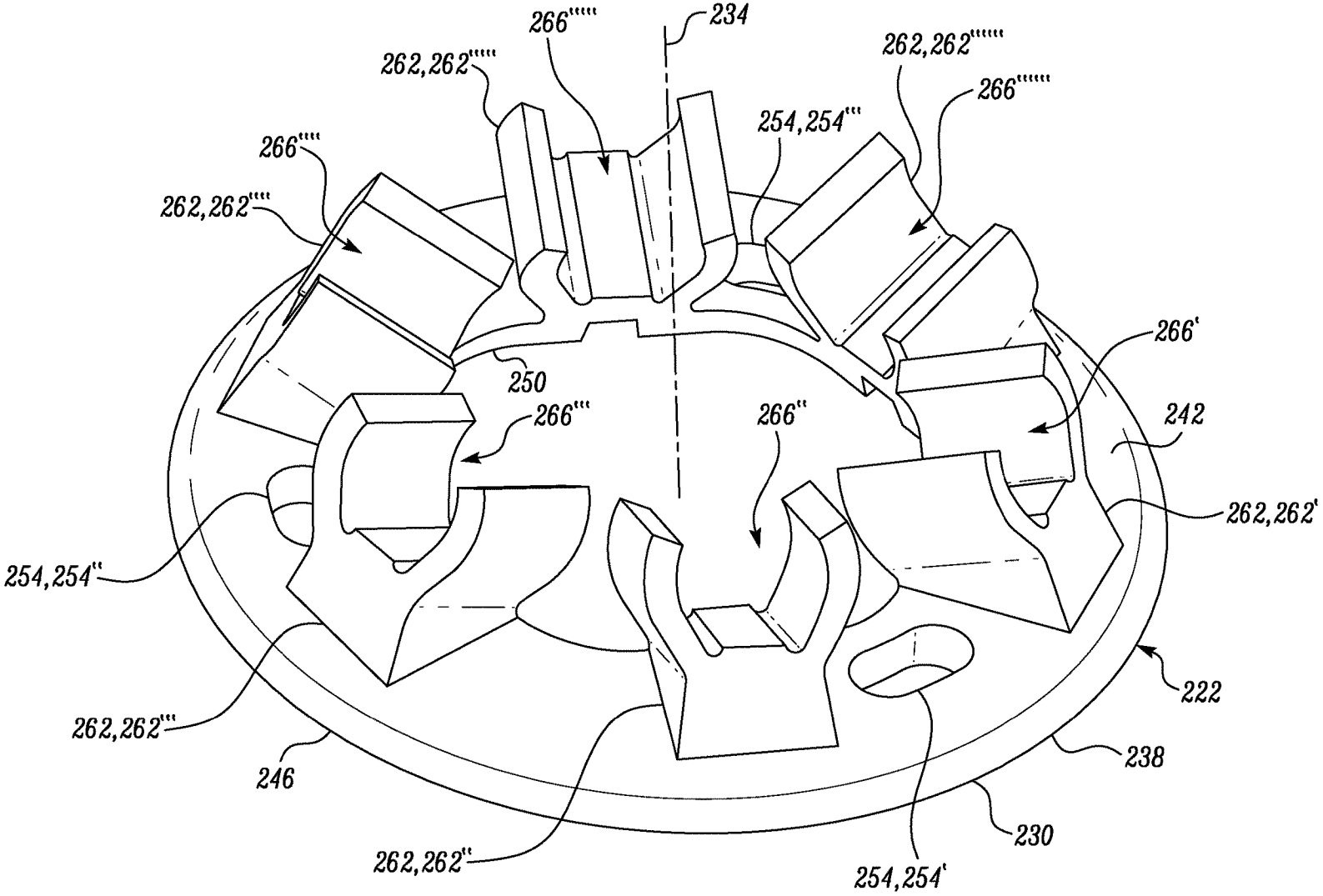
FIG. 4 is a perspective view of the base of the duct assembly with the duct bodies removed, in accordance with an aspect of the present disclosure.

Referring to FIGS. 2, 3, and 4, the base 222 of the duct assembly 198 may include an annular or ring-shaped portion 230 that defines a base axis 234, a first axial base end 238, and a second axial base end 242 disposed opposite to the first axial base end 238, an outer periphery 246, and an inner periphery 250. The ring-shaped portion 230 may include a number of slots 254', 254", 254'". Collectively, the slots 254', 254", 254'" may be referred to as a slots 254, with each of the slots 254 extending between the first axial base end 238 and the second axial base end 242 of the ring-shaped portion 230. A shape and profile of the slots 254 may differ from what is depicted, and, thus, need to be seen as exemplary. In one example, the slots 254 may be circular shaped (i.e., shaped as holes) that extend between the first axial base end 238 and the second axial base end 242. As an example, the slots 254 may be three in number, as shown, although a higher or a lower number of slots 254 may be contemplated. Further, the slots 254 may be arrayed equidistantly around the base axis 234, although a variation in the arrangement of the slots 254 is possible.

The slots 254 may receive fasteners 258 (e.g., threaded fasteners, such as bolts or screws) such that the fasteners 258 may be used to engage and couple the ring-shaped portion 230 (and thus the base 222) to the flame deck surface 158 of the cylinder head 148. In one example, the fasteners 258 may be inserted into the slots 254 from the second axial base end 242 towards the first axial base end 238 such that the fasteners 258 (i.e., head portions of the fasteners 258) may engage the second axial base end 242 of the ring-shaped portion 230 and a length thereof (e.g., threaded shank portions of the fasteners 258) is driven into a receptacle (e.g., receiving holes such as tapped holes) of the flame deck surface 158 so as to engage and retain the ring-shaped portion 230 and thus the base 222 to the flame deck surface 158 of the cylinder head 148. Said portion of the flame deck surface 158 may be a portion of the flame deck surface 158 defined around the tip portion 206 of the fuel injector 194. By way of such assembly, the first axial base end 238 may abut and rest against the flame deck surface 158 of the cylinder head 148, while the second axial base end 242 may be directed away from the flame deck surface 158 of the cylinder head 148 to face and be exposed to the combustion chamber 162 of the engine 100.

The base 222 includes a number of spaced apart receptacles (or simply, receptacles 262, hereinafter). The receptacles 262 are disposed on the second axial base end 242 of the ring-shaped portion 230 that is directed away from the flame deck surface 158 of the cylinder head 148 and is exposed to the combustion chamber 162 of the engine 100. As an example, the base 222 includes six receptacles 262', 262", 262'", 262"", 262'"", 262""", although a lesser or a higher number of receptacles 262 may be contemplated. The receptacles 262 may be equidistantly spaced apart on the second axial base end 242 and rotationally arrayed around the base axis 234. The receptacles 262', 262", 262'", 262"", 262'"", 262""" define corresponding cavities 266', 266", 266'", 266"", 266'"", 266""" therein to correspondingly receive and secure the duct bodies 226', 226", 226'", 226"", 226'"", 226""" therein, i.e., one receptacle (e.g., receptacle 262") receives and secures one duct body (e.g., duct body 226") in its cavity (e.g., cavity 266"). The disclosure below highlights further details of the duct bodies 226 and the receptacles 262. Such details may be discussed by reference to the duct body 226" and to the receptacle 262"—said details and discussions may be suitably applied to each of the other remaining duct bodies 226 and receptacles 262, as well. For ease and simplicity, the duct body 226" and the receptacle 262" may respectively be referred to as the duct body 226 and the receptacle 262. The cavity 266" of the receptacle 262 may also be simply referred to as cavity 266. Wherever required, references to the duct bodies 226 and the receptacles 262 by way of their individual annotations, as have been assigned above, may also be used.

Figure 5:
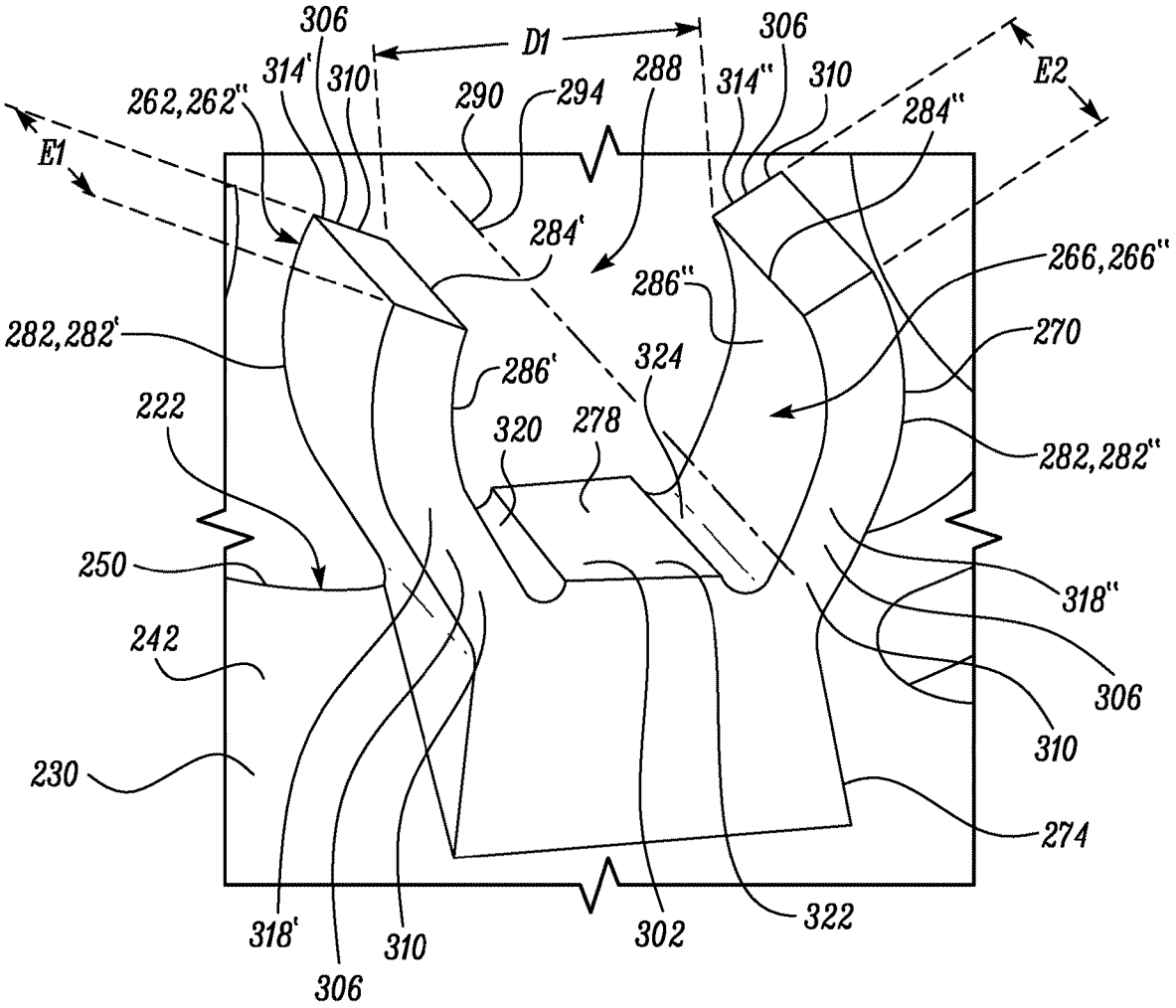
FIG. 5 is an enlarged perspective view of one of the receptacles of the base, in accordance with an aspect of the present disclosure.

Referring to FIG. 5, the receptacle 262 includes a U-shaped portion 270 and a post portion 274. The U-shaped portion 270 defines a floor portion 278 and a pair of resilient or deflectable arms 282, including a first arm 282' and a second arm 282", while the post portion 274 extends between the floor portion 278 and the ring-shaped portion 230 to support the floor portion 278 (and, in turn, the U-shaped portion 270) on the ring-shaped portion 230, as shown. In one example, the receptacle 262 (including the U-shaped portion 270 and the post portion 274) in conjunction with the ring-shaped portion 230 may be all formed together as a single piece, helping the base 222 attain a unitary, integrated structure. Also, the base 222 may be made from a metallic material, although it is possible for the base 222 to be made from a combination of materials—for example, the base 222 may be made from an alloy. Although not limited, manufacturing processes, such as MIM (metal injection molding) process, progressive stamping, and 3D printing, may be used to produce the base 222.

Both the first arm 282' and the second arm 282" extend away from the floor portion 278. As shown, the first arm 282' and the second arm 282" extend in the same direction (e.g., upwards or generally along the base axis 234, see FIG. 4) away from the second axial base end 242 of the ring-shaped portion 230 to respectively define a first top edge 284' and a second top edge 284", as depicted. The first top edge 284' and the second top edge 284" are spaced apart from each other by a distance, D1, and define a mouth 288 of the cavity 266 through which the duct body 226 may be inserted and secured within the cavity 266.

The first arm 282' and the second arm 282" also define corresponding inner surfaces (i.e., a first arm inner surface 286' and a second arm inner surface 286") that face each other. As shown, both the first arm inner surface 286' and the second arm inner surface 286" extend respectively from the first top edge 284' and the second top edge 284" and extend further towards the floor portion 278. Each of the first arm inner surface 286' and the second arm inner surface 286" define a curved or an arcuate profile, with concavities defined by said arcuate profiles facing each other, as well. Also, as an example, the arcuate profile defined by the first arm inner surface 286' may be similar (or congruous) to the arcuate profile defined by the second arm inner surface 286". Further, the concavities defined by the first arm inner surface 286' and the second arm inner surface 286" may be defined around a common axis 290, as well. The common axis 290 may be referred to as a receptacle axis 294 of the receptacle 262 defined by the cavity 266 of the receptacle 262, or simply, the 'receptacle axis 294', hereinafter. The receptacle axis 294 meets the base axis 234 at a point 298 and defines an inclination (see angle, A) with respect to the base axis 234 (see FIG. 7).

As shown, the floor portion 278, the first arm inner surface 286' and the second arm inner surface 286", each define corresponding lengths that extend along the receptacle axis 294, in and along a radial direction defined between the outer periphery 246 and the inner periphery 250 of the ring-shaped portion 230 of the base 222. As may be noted, the floor portion 278 along with the first arm 282' and the second arm 282" together define the cavity 266 of the receptacle 262. In some embodiments, a cross-section of the cavity 266 defined along the receptacle axis 294 may be uniform. The distance, D1, may also be uniform along the receptacle axis 294. The cavity 266 further defines a rotational engagement surface 302 and an axial engagement surface 306.

Figure 6:
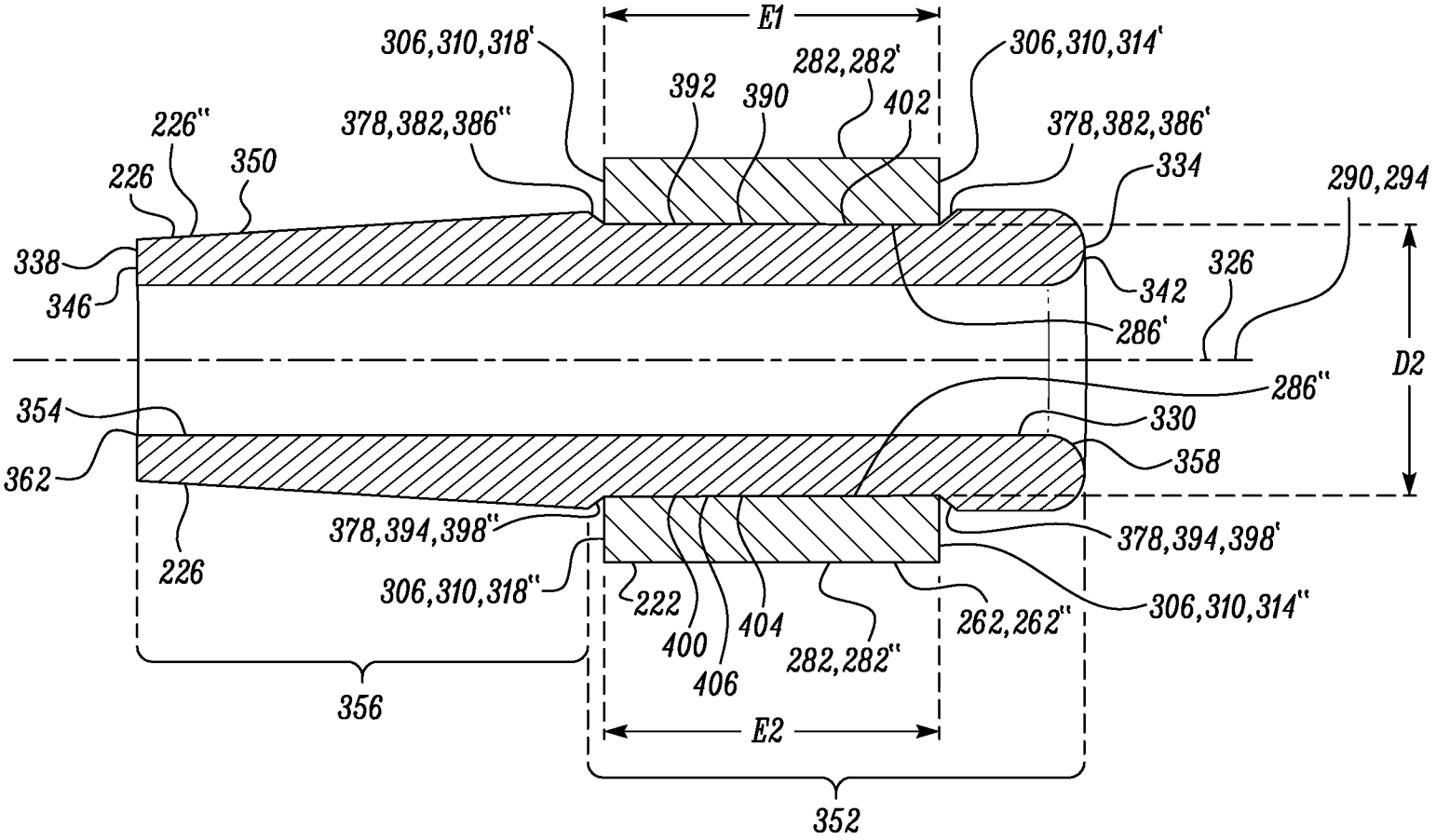
FIG. 6 is a cross-sectional view of one of the duct bodies secured within a cavity of one of the receptacles of the base taken generally along line 6-6 in FIG. 9, and in accordance with an aspect of the present disclosure.

Referring to FIGS. 5 and 6, the axial engagement surface 306 includes corresponding lateral side edges 310 of the first arm 282' and the second arm 282". For example, the lateral side edges 310 of the first arm 282' includes a first lateral side edge 314' and a second lateral side edge 318'. Similarly, the lateral side edges 310 of the second arm 282" include a first lateral side edge 314" and a second lateral side edge 318". The first lateral side edges 314', 314" are relatively closer to the inner periphery 250 than to the outer periphery 246 of the ring-shaped portion 230, while the second lateral side edges 318', 318" are relatively closer to the outer periphery 246 than to the inner periphery 250 of the ring-shaped portion 230. As shown, a distance, E1, is defined between the first lateral side edge 314' and the second lateral side edge 318' of the first arm 282' and a distance, E2, is defined between the first lateral side edge 314" and the second lateral side edge 318" of the second arm 282". In one example, both the distances, E1 and E2, are equal to each other. In some embodiments, the axial engagement surface 306 may refer to or include only one of: the first lateral side edge 314' and the second lateral side edge 318' of the first arm 282'; or the first lateral side edge 314" and the second lateral side edge 318" of the second arm 282".

With regard to the rotational engagement surface 302 of the receptacle 262, the rotational engagement surface 302 includes a first receptacle flat surface 322 disposed on the floor portion 278 of the U-shaped portion 270. The first receptacle flat surface 322 extends (e.g., uninterruptedly) along the receptacle axis 294 across the floor portion 278.

Referring to FIG. 5, at least one of the first arm 282' or the second arm 282" is deflectable with respect to the floor portion 278 to make way and allow for an insertion and assembly of the duct body 226 into the cavity 266 of the receptacle 262. In the disclosed embodiment, both the first arm 282' and the second arm 282" are deflectable with respect to the floor portion 278. The deflectable nature of the first arm 282' and the second arm 282" also enables the first arm 282' and the second arm 282" to resiliently engage a portion of the duct body 226 and secure the duct body 226 therebetween. During an assembly of the duct body 226 into the cavity 266 of the receptacle 262 through the mouth 288, the distance, D1, may change (e.g., increase) owing to said deflectable nature of the first arm 282' and the second arm 282". Discussions related to such an assembly of the duct body 226 into the cavity 266 of the receptacle 262 is provided later in the present disclosure.

According to an aspect of the present disclosure, the U-shaped portion 270 defines corresponding grooves at an interface between the floor portion 278 and each of the first arm 282' and the second arm 282". For example, the U-shaped portion 270 defines a first groove 320 between the first arm 282' and the floor portion 278 and defines a second groove 324 between the second arm 282" and the floor portion 278. The first groove 320 and the second groove 324 relieve stress from the corresponding interfaces during a deflection of the first arm 282' and the second arm 282". The first groove 320 and the second groove 324 also provide flexibility to the first arm 282' and the second arm 282".

Referring to FIG. 6, the duct body 226 of the duct assembly 198 is configured to be received and secured within the cavity 266 of the receptacle 262. The duct body 226 may include an elongated cylindrically shaped profile, as shown. The duct body 226 defines an axis (referred to as a duct axis 326, hereinafter) and a duct 330 extending therethrough along the duct axis 326 to provide a passage for a corresponding fuel jet discharged from one of the orifices 214 of the fuel injector 194. As shown, the duct body 226 may include a first axial end 334 and a second axial end 338 opposite to the first axial end 334. A first axial end face 342 is defined at the first axial end 334 while a second axial end face 346 is defined at the second axial end 338.

According to an aspect of the present disclosure, the duct body 226 also defines an outer surface 350. The outer surface 350 may include a straight part 352 and a tapering part 356. For example, the straight part 352 extends from the first axial end 334 towards the second axial end 338 and the tapering part 356 extends from the straight part 352 to the second axial end 338. Further, an inner surface 354 of the duct body 226 is defined by the duct 330 extending through the duct body 226. As shown, the duct 330 extends from the first axial end 334 to the second axial end 338 and defines an arcuate inlet surface 358 at the first axial end 334 to receive the corresponding fuel jet from the first axial end 334 and a sharp edged outlet 362 at the second axial end 338 to expel the corresponding fuel jet through the second axial end 338.

The arcuate inlet surface 358, according to an aspect of the present disclosure, extends from the inner surface 354 all the way to the outer surface 350 in the form of a circular arc (in cross-section) or defines an arcuate cross-section, as shown. The arcuate inlet surface 358 eases receipt of the corresponding fuel jet into the duct 330. In one example, the arcuate inlet surface 358 is 180 degrees rounded in cross-section or profile. In some embodiments, the arcuate inlet surface 358 may be configured with an arcuate cross-section less than 180 degrees but greater than 90 degrees. Providing a cross-section greater than 90 degrees may improve the flow of the air into the duct 330. In one embodiment, the arcuate cross-section may be at least 150 degrees. In another embodiment, the arcuate cross-section may be at least 130 degrees. In still another embodiment, the arcuate cross-section may be at least 115 degrees. In each instance, the first 90 degrees is measured from the inner surface 354 of the duct 330 and the extent of the arcuate inlet surface 358 greater than 90 degrees extends from the first axial end 334 towards the outer surface 350 of the duct body 226.

The sharp edged outlet 362 has a sharp edged cross-section or profile that defines an interface between the inner surface 354 of the duct body 226 and the second axial end face 346. The inner surface of 354 of the duct 330 may define a constant cross-section along the duct axis 326 or along the duct's extension within the duct body 226. However, in some embodiments, a non-constant cross-section, such as a varying cross-section of the duct 330 along the duct axis 326, may be contemplated.

Figure 8:
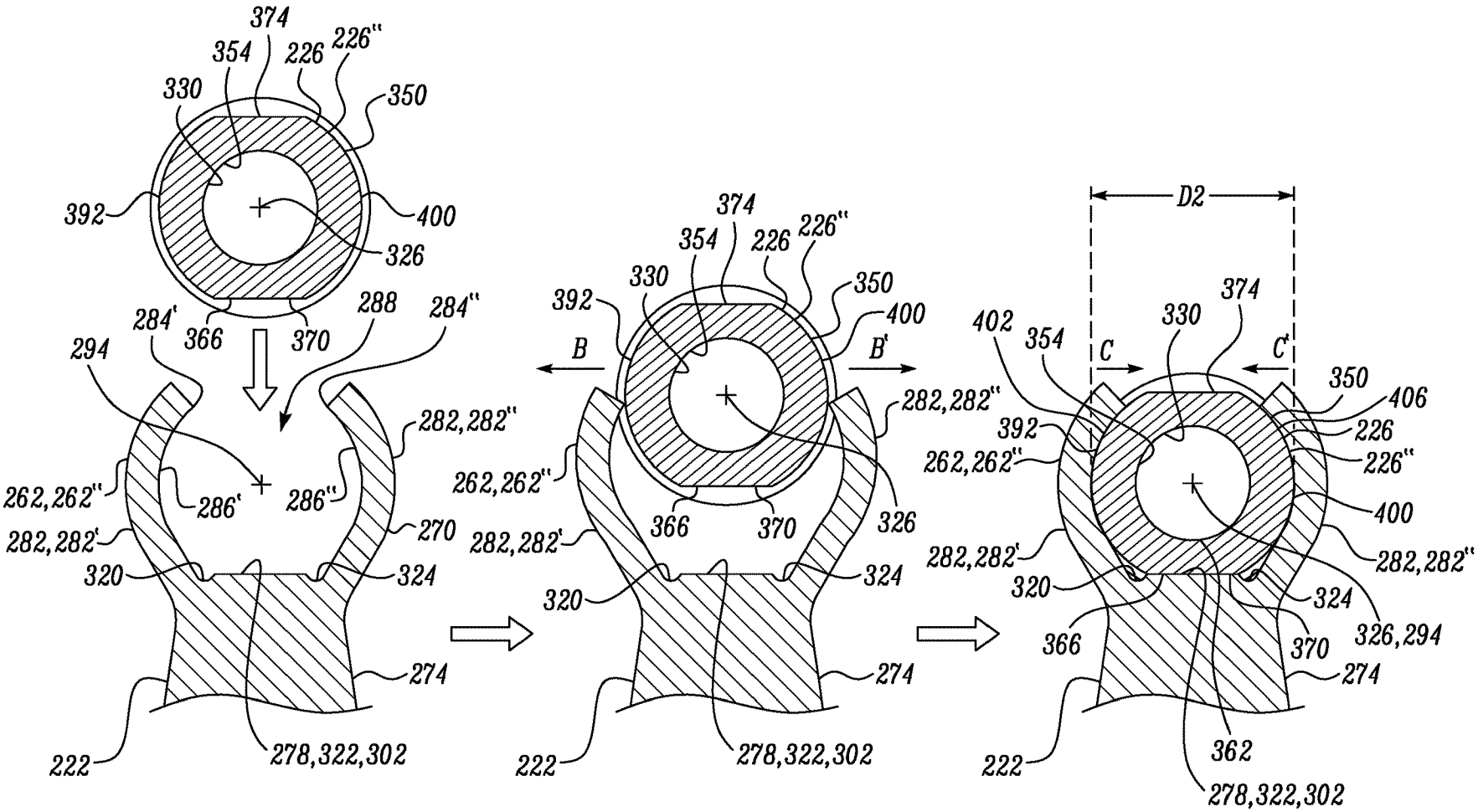
FIG. 8 is a diagrammatic sectional view of a process for assembling one of the duct bodies within the cavity of the one of the receptacles of the base, in accordance with an aspect of the present disclosure.

Referring to FIGS. 2, 6, and 8, the duct body 226 defines a rotational alignment surface 366. The rotational alignment surface 366 includes a first duct flat surface 370. The first duct flat surface 370 may be formed on the outer surface 350 of the duct body 226 and may extend from the first axial end 334 to the second axial end 338, although it is possible for the first duct flat surface 370 to fall short or stop midway of a distance defined between the first axial end 334 and the second axial end 338.

According to an embodiment of the present disclosure, the duct body 226 also defines a second duct flat surface 374 (also see FIG. 3 and FIG. 8) that is disposed diametrically opposite to the first duct flat surface 370. In some embodiments, the second duct flat surface 374 may be similar (or congruous) in profile to the first duct flat surface 370. Further, given that the second duct flat surface 374 is disposed diametrically opposite to the first duct flat surface 370, the second duct flat surface 374 may be parallely defined with respect to the first duct flat surface 370. Both the first duct flat surface 370 and the second duct flat surface 374 may be provided to reduce the vertical profile of the duct assembly 198 such as to provide sufficient clearance to the piston crown 128 (or the bowl portion) during engine operations.

Referring to FIG. 6, the duct body 226 further defines an axial alignment surface 378. The axial alignment surface 378 of the duct body 226 includes axially spaced apart ridges 382 (or simply, ridges 382) along the outer surface 350 of the duct body 226. For example, the axial alignment surface 378 includes two ridges 382—a first ridge 386' and a second ridge 386", as shown in cross-section. The first ridge 386' is disposed relatively proximal to the first axial end 334, while the second ridge 386" is disposed relatively distal from the first axial end 334. In some embodiments, the axial alignment surface 378 includes another set of axially spaced apart ridges 394 (or simply, ridges 394)—e.g., a third ridge 398' and a fourth ridge 398" defined diametrically opposite to the axially spaced apart ridges 382 or the first ridge 386' and the second ridge 386", as shown in cross-section. The third ridge 398' is disposed relatively proximal to the first axial end 334, while the fourth ridge 398" is disposed relatively distal from the first axial end 334.

A first straight surface 392 (i.e., extending straight along the duct axis 326) may be defined between the first ridge 386' and the second ridge 386". Similarly, a second straight surface 400 (i.e., extending straight along the duct axis 326) may be defined between the third ridge 398' and the fourth ridge 398". The first straight surface 392 may be disposed diametrically opposite to the second straight surface 400. A distance, D2, may be defined between the first straight surface 392 and the second straight surface 400, as shown. The distance, D2, may be defined along a diameter of the duct body 226 (also visualized in FIG. 8). Also, distance, D2, is larger than distance, D1 (see FIG. 5). Further, a length defined by the first straight surface 392 along the duct axis 326 may be equal to the distance, E1, and a length defined by the second straight surface 400 along the duct axis 326 may be equal to the distance, E2. Given that, in an embodiment, the distances, E1 and E2, are equal, lengths defined by the first straight surface 392 and the second straight surface 400, along the duct axis 326, may be equal as well.

In some embodiments, both the first ridge 386' and the second ridge 386" may extend partly circumferentially around the outer surface 350 (e.g., on the straight part 352 of the outer surface 350) of the duct body 226. Similarly, both the third ridge 398' and the fourth ridge 398" may extend partly circumferentially around the outer surface 350 (e.g., on the straight part 352 of the outer surface 350) of the duct body 226. In such a case, it may be further noted that portions of an outer surface 402, 406 of the first straight surface 392 and second straight surface 400, respectively, may be curved (also see FIG. 8) around the duct axis 326, as well, and may be configured to engage the first arm inner surface 286' and the second arm inner surface 286" of the first arm 282' and the second arm 282" of the receptacle 262, respectively, upon insertion of the duct body 226 into the receptacle 262. In some embodiments, the first ridge 386' may extend circumferentially around the outer surface 350 of the duct body 226 and may meet the third ridge 398'. Similarly, in some embodiments, the second ridge 386" may extend circumferentially around the outer surface 350 of the duct body 226 and may meet the fourth ridge 398".

In some embodiments, each of the first straight surface 392 and the second straight surface 400 may be recessed relative to other portions of the outer surface 350 of the duct body 226, and, thus, the first straight surface 392 in conjunction with the first ridge 386' and the second ridge 386" may define a first recessed portion 390 of the duct body 226. Similarly, the second straight surface 400 in conjunction with the third ridge 398' and the fourth ridge 398'" may define a second recessed portion 404 of the duct body 226.

In some embodiments, the ridges 382 may be protuberances extending partly circumferentially outwards around the outer surface 350 (e.g., on the straight part 352 of the outer surface 350) of the duct body 226. Similar discussions may be contemplated for the ridges 394, as well. Further, like the base 222, the duct body 226 may be an integrated structure and may be formed together as a single piece. As an example, the duct body 226 may be made from a metallic material, although it is possible for the base 222 to be made from a combination of materials—for example, the duct body 226 may be made from an alloy. The duct body 226 may also be made from ceramic or from a combination of a metal and ceramic. In one embodiment, the duct body 226 is made from the same material as the base 222. Although not limited, manufacturing processes, such as screw-machining and 3D printing may be used to produce the duct body 226.

During assembly (i.e., insertion and securement) of the duct body 226 within the cavity 266 of the receptacle 262, the rotational alignment surface 366 of the duct body 226 engages the rotational engagement surface 302 of the receptacle 262 in which it is disposed to rotationally align the duct body 226 along the receptacle axis 294 of the receptacle 262. Further, during assembly of the duct body 226 within the cavity 266 of the receptacle 262, the axial alignment surface 378 of the duct body 226 engages the axial engagement surface 306 of the receptacle 262 in which it is disposed to axially align the duct body 226 along the receptacle axis 294 of the receptacle 262. Details regarding an exemplary process involving the assembly of the duct body 226 with the cavity 266 of the receptacle 262 shall be discussed further below in the present disclosure.

Figure 10:
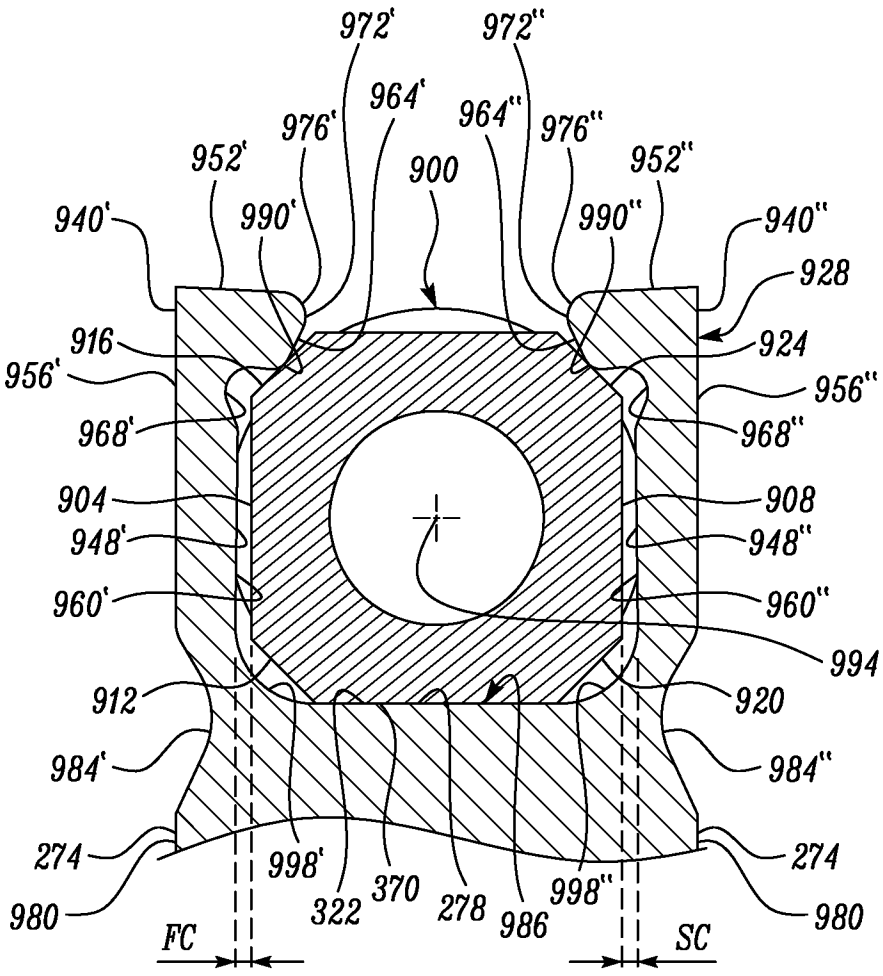
FIG. 10 is cross-sectional view of an assembly of a duct body and a receptacle, illustrating variations in the duct body and the receptacle of FIGS. 1 to 9, in accordance with an aspect of the present disclosure.
Figure 11:
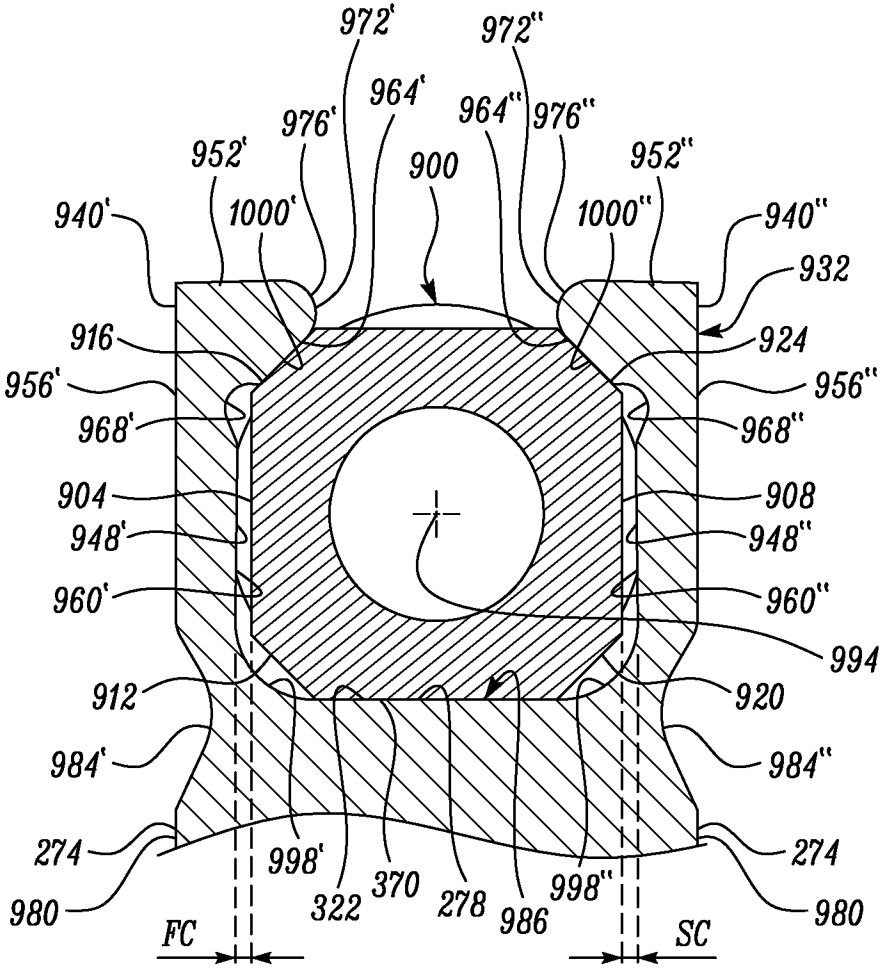
FIG. 11 is a cross-sectional view of an assembly of the duct body of FIG. 10 within a receptacle that is a variant of the receptacle of FIG. 10, in accordance with an aspect of the present disclosure.
Figure 12:
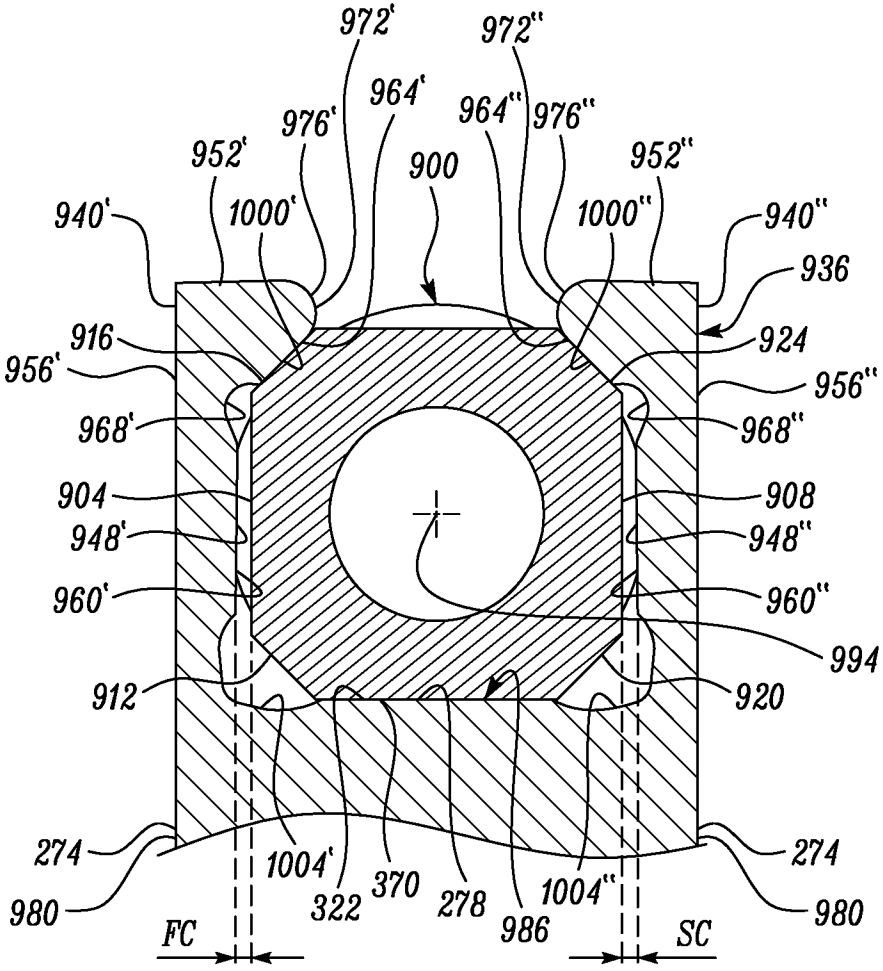
FIG. 12 is a is a cross-sectional view of an assembly of the duct body of FIG. 10 within a receptacle that is a variant of the receptacle of FIG. 11, in accordance with an aspect of the present disclosure.

Referring to FIGS. 10, 11, and 12, aspects related to one or more variations in the structure of the duct body 226 and the receptacle 262 shall now be discussed. As shown, each of FIGS. 10, 11, and 12 relate to a duct body 900 that has certain variations in structure when compared to the structure of the duct body 226, discussed above. Said variations have been illustrated and disclosed by way of cross-sectional views of the duct body 900 provided in each of the FIGS. 10, 11, and 12. The duct body 900 may include one or more features and elements as have been discussed for the duct body 226, and thus one or more of the same or similar reference numerals and nomenclatures shall be applicable to the duct body 900 as have been applied for the duct body 226. However, several reference numerals used for the duct body 900 may differ from or be in addition to the reference numerals that have been used for the duct body 226 in order to highlight and discuss the differences of the duct body 900 from the duct body 226.

The duct body 900 includes a first straight surface 904 and a second straight surface 908 in place of the first straight surface 392 and the second straight surface 400 of the duct body 226. As shown, the first straight surface 904 and the second straight surface 908 of the duct body 900 may be flat and planar surfaces unlike the first straight surface 392 and the second straight surface 400 of the duct body 226 that may be curved around the duct axis 326 (see FIG. 8). The first straight surface 904 and the second straight surface 908 may be parallel to each other, as well. Further, the duct body 900 defines a first connecting surface 912, a second connecting surface 916, a third connecting surface 920, and a fourth connecting surface 924. The first connecting surface 912 extends between the first straight surface 904 and the first duct flat surface 370 of the duct body 900, the second connecting surface 916 extends between the first straight surface 904 and the second duct flat surface 374 of the duct body 900, the third connecting surface 920 extends between the second straight surface 908 and the first duct flat surface 370 of the duct body 900, and the fourth connecting surface 924 extends between the second straight surface 908 and the second duct flat surface 374 of the duct body 900. Each of the first connecting surface 912, the second connecting surface 916, the third connecting surface 920, and the fourth connecting surface 924, may be flat surfaces as well. Combined, therefore, the first duct flat surface 370, the first connecting surface 912, the first straight surface 904, the second connecting surface 916, the second duct flat surface 374, the fourth connecting surface 924, the second straight surface 908, and the third connecting surface 920 may impart an octagonal cross-section to the duct body 900, as shown.

FIGS. 10, 11, and 12 correspondingly also relate to receptacles 928, 932, 936 that can accommodate the duct body 900. The receptacles 928, 932, 936 include variations in their structure when compared to each other and when compared to the structure of the receptacle 262. Said variations have been illustrated and disclosed by way of cross-sectional views of the receptacles 928, 932, 936 provided respectively in FIGS. 10, 11, and 12. Each of the receptacles 928, 932, 936 may include one or more features and elements as have been discussed for the receptacle 262, and thus one or more of the same or similar reference numerals and nomenclatures shall be applicable to each of the receptacles 928, 932, 936 as have been applied for the receptacle 262. However, several reference numerals used for the receptacles 928, 932, 936 may differ from or be in addition to the reference numerals that have been used for the receptacle 262 in order to highlight and discuss the differences of the receptacles 928, 932, 936 from the receptacle 262.

Referring to FIG. 10, the receptacle 928 is shown. The receptacle 928 includes a first arm 940' and a second arm 940". The first arm 940' defines a first arm inner surface 948', a first arm top surface 952', and a first arm exterior surface 956'. The first arm inner surface 948' defines a first upright section 960', a first protruded section 964', and a first recessed section 968' defined in between the first upright section 960' and the first protruded section 964'. The first upright section 960' is disposed proximal to the floor portion 278 (or the first receptacle flat surface 322) of the receptacle 928, while the first protruded section 964' is disposed distal to the floor portion 278 (or the first receptacle flat surface 322) of the receptacle 928 and defines a first top edge 972' of the first arm 940'. As exemplarily shown, the first top edge 972' includes a first rounded surface 976' that extends contiguously from the first protruded section 964' and merges contiguously and seamlessly with the first arm top surface 952' of the first arm 940'. Further, the first arm exterior surface 956' merges with an external surface 980 of the post portion 274 of the receptacle 928 by way of a first depressed surface 984' that forms an interface between the first arm exterior surface 956' and the external surface 980 of the post portion 274.

Similarly, the second arm 940" defines a second arm inner surface 948", a second arm top surface 952", and a second arm exterior surface 956". The second arm inner surface 948" defines a second upright section 960", a second protruded section 964", and a second recessed section 968" defined in between the second upright section 960" and the second protruded section 964". The second upright section 960" is disposed proximal to the floor portion 278 (or the first receptacle flat surface 322) of the receptacle 928, while the second protruded section 964" is disposed distal to the floor portion 278 (or the first receptacle flat surface 322) of the receptacle 928 and defines a second top edge 972" of the second arm 940". As exemplarily shown, the second top edge 972" includes a second rounded surface 976" that extends contiguously from the second protruded section 964" and merges contiguously and seamlessly with the second arm top surface 952" of the second arm 940". Further, the second arm exterior surface 956" merges with the external surface 980 of the post portion 274 of the receptacle 928 by way of a second depressed surface 984" that forms an interface between the second arm exterior surface 956" and the external surface 980 of the post portion 274.

The first arm inner surface 948' and the second arm inner surface 948", in conjunction with the floor portion 278, defines a cavity 986 of the receptacle 928. It may be noted that the first protruded section 964' and the second protruded section 964" may be directed towards each other, inwards into the cavity 986, as shown. The first protruded section 964' and the second protruded section 964" correspondingly define a first protruded edge 990' and a second protruded edge 990", both facing inwards into the cavity 986, as well. In some embodiments, the first protruded edge 990' and the second protruded edge 990' are filleted edges. In some embodiments, the first protruded edge 990' and the second protruded edge 990" define lengths that may extend along an axis 994 (similar to the receptacle axis 294) defined by the cavity 986. Furthermore, as may be noted, the first groove 320 and the second groove 324 may be missing respectively from between the first arm 940' and the floor portion 278 and between the second arm 940" and the floor portion 278. Instead, there may be a first rounded continuous surface 998' extending (e.g., with curvature continuity and as an interface) between the first arm 940' and the floor portion 278 and a second rounded continuous surface 998" extending (e.g., with curvature continuity and as an interface) between the second arm 940" and the floor portion 278.

Referring to FIG. 11, with regard to the receptacle 932, all features and references of the receptacle 932 may remain similar to the features and references of the receptacle 928 with the exception that in place of the first protruded edge 990' and the second protruded edge 990", the first protruded section 964' and the second protruded section 964" of the receptacle 932 respectively defines a first flat face 1000' and a second flat face 1000", as shown. The first flat face 1000' and the second flat face 1000" may be directed into the cavity 986 and may define lengths that extend along the axis 994.

Referring to FIG. 12, with regard to the receptacle 936, all features and reference of the receptacle 936 remain similar to the features and references of the receptacle 932 with the exception that in place of the first rounded continuous surface 998' and the second rounded continuous surface 998", a first transition surface 1004' and a second transition surface 1004" are defined that are more pronounced than the first rounded continuous surface 998' and the second rounded continuous surface 998". More particularly, the first transition surface 1004' and the second transition surface 1004" extend into the body of the receptacle 936, as shown, in a manner to minimize the material at the interface between the arms 940', 940" and the post portion 274 so as to make the arms 940', 940" more flexible and/or deflectable with respect to the floor portion 278 (or the post portion 274). The first depressed surface 984' and the second depressed surface 984" may be omitted from the receptacle 936.

Figure 13:
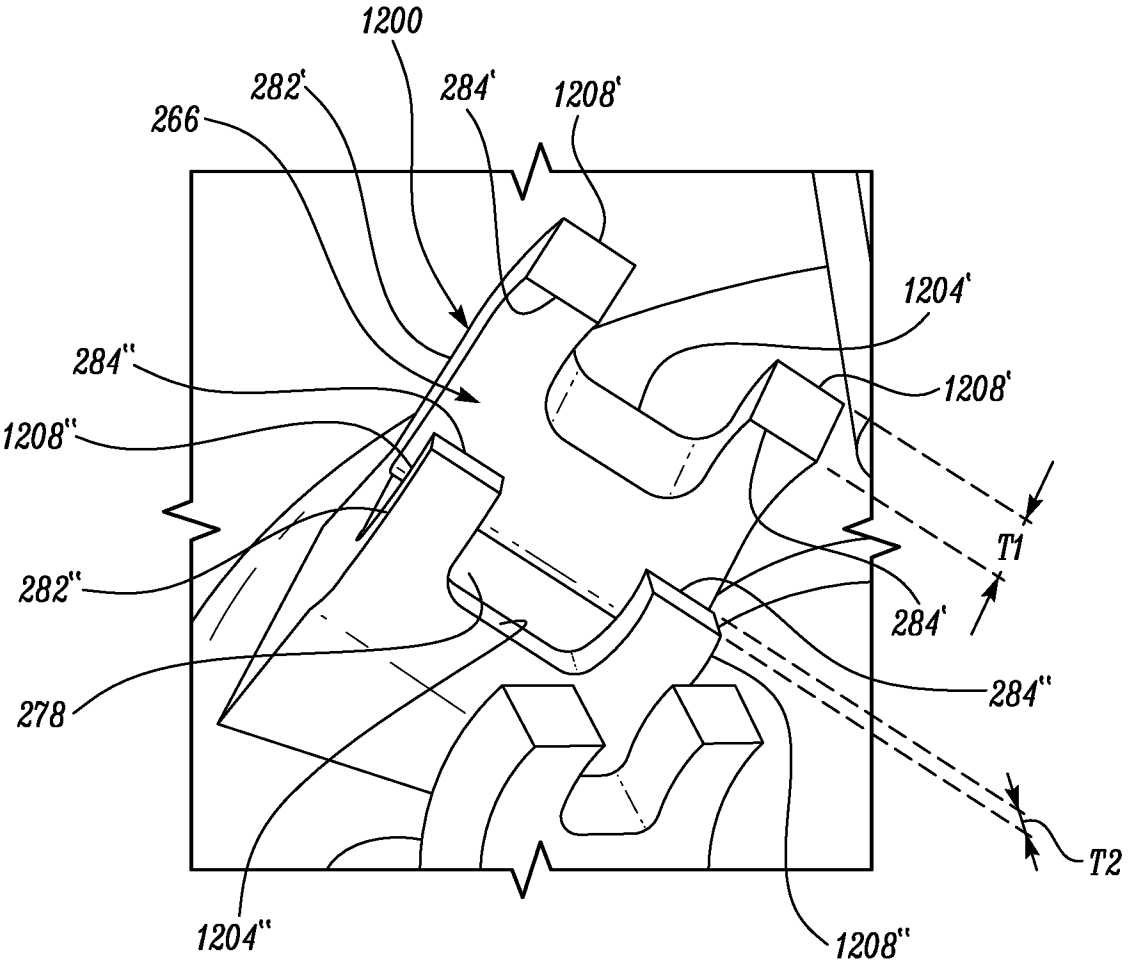
FIG. 13 is a receptacle that is a variant of the receptacle described in FIGS. 1 to 9, in accordance with an aspect of the present disclosure.

Referring to FIG. 13, certain further optional embodiments or variations related to the receptacle 262 have been discussed. Said variations have been discussed with reference to a receptacle 1200 that is a variant of the receptacle 262"" (see FIG. 4). All reference numerals applied for the receptacle 262 may be applied to the receptacle 1200, as well, to illustrate same or like parts. However, the receptacle 1200 may include references to reference numerals that may differ from or be in addition to the reference numerals that have been used for the receptacle 262 in order to highlight and discuss the differences/variations between the receptacle 1200 and the receptacle 262.

The first arm 282' and the second arm 282" of the receptacle 1200 may respectively include a first cutout 1204' and a second cutout 1204", as shown. The first cutout 1204' and the second cutout 1204" may respectively extend from the first top edge 284' and the second top edge 284" of the first arm 282' and the second arm 282" towards the floor portion 278 of the receptacle 1200. Both the first cutout 1204' and the second cutout 1204" extend through the thicknesses, T1 and T2, defined by the first arm 282' and the second arm 282" to define spaced apart pair of fingers (e.g., a first pair of finger 1208' and a second pair of fingers 1208") on the first arm 282' and the second arm 282", as shown. Further, both the first cutout 1204' and the second cutout 1204" may be U-shaped, although the first cutout 1204' and the second cutout 1204" may be differently shaped, e.g., one or more of the first cutout 1204' and the second cutout 1204" may include a V-shape. By way of the first cutout 1204' and the second cutout 1204", material from the first arm 282' and the second arm 282" may be minimized, flexibility of the first arm 282' and the second arm 282" be increased, and an insertion and assembly of the duct body 226 into the cavity 266 may be further eased. Further, features discussed for the receptacle 1200 may suitably be applied to the receptacles 928, 936, 938, as well.

INDUSTRIAL APPLICABILITY

During assembly of the duct assembly 198 to the flame deck surface 158 of the cylinder head 148, an operator may bring forth the base 222, place it against the portion of the flame deck surface 158 defined around the tip portion 206, and align the base 222 such that the receptacle axis 294 of the receptacle 262 (and the receptacle axes of the remaining receptacles 262) fall in line and align with corresponding orifices 214 of the tip portion 206 of the fuel injector 194. Thereafter, the operator may insert the fasteners 258 through the slots 254 such that the fasteners 258 (e.g., head portions of the fasteners 258) may engage the second axial base end 242 of the ring-shaped portion 230 and the fasteners 258 (e.g., shank portions of the fasteners 258) may pass through and beyond the first axial base end 238 into corresponding receiving holes (not shown) provided within the flame deck surface 158 of the cylinder head 148. The fasteners 258 may then be turned into such holes by use of a suitable tool or a driver and be tightly retained to the flame deck surface 158 so as to immovably retain the base 222 with the flame deck surface 158. As a result, the base 222 is assembled and retained with the flame deck surface 158 such that the receptacle axis 294 of the receptacle 262 (and receptacle axes of the remaining receptacles 262) are aligned with corresponding orifices 214 of the fuel injector 194. Also, once the base 222 is assembled to the flame deck surface 158, the base axis 234 may lie in line with the longitudinal axis 220 of the fuel injector 194 (see FIG. 1).

Figure 7:
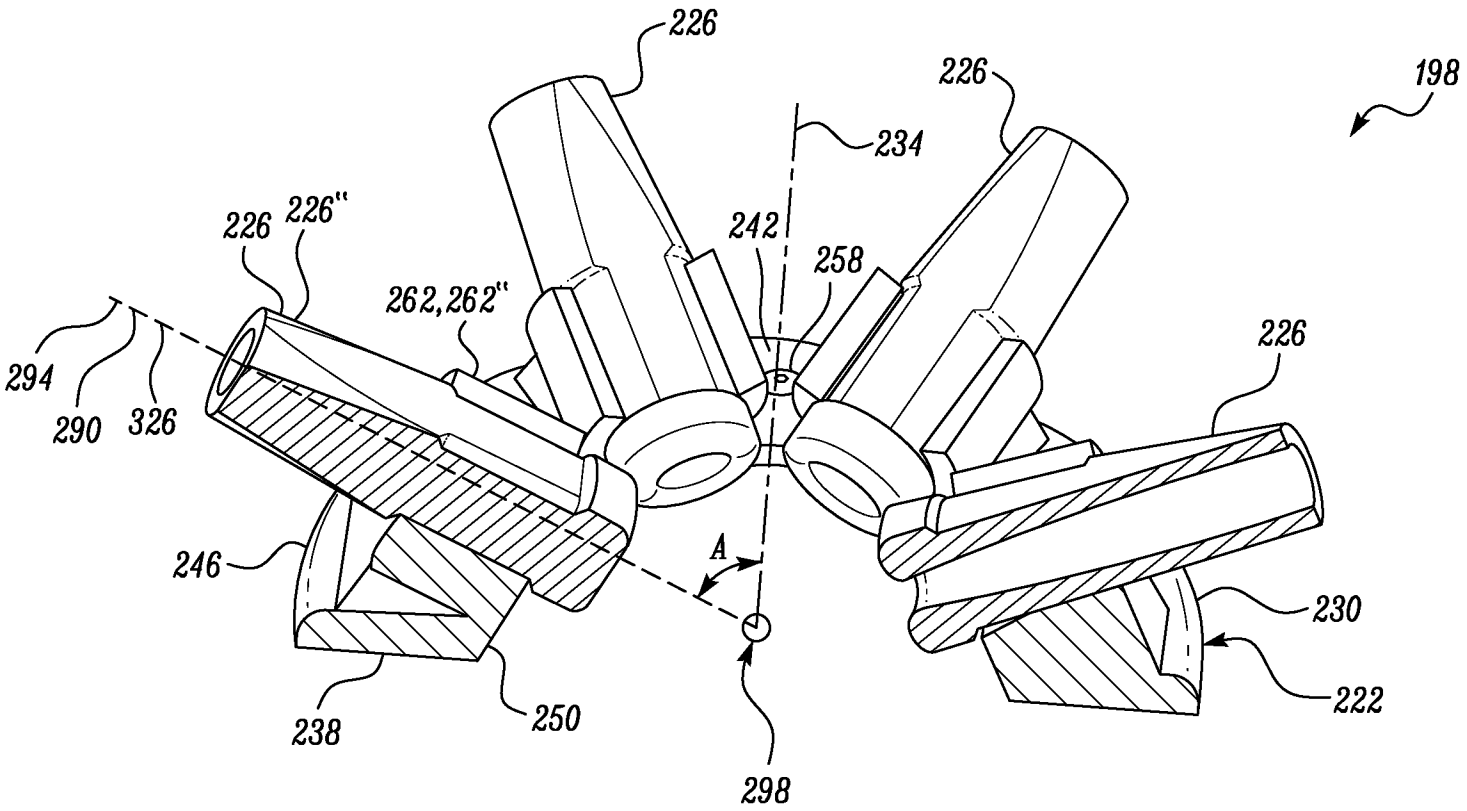
FIG. 7 is a cross-sectional perspective view of the duct assembly taken generally along line 7-7 in FIG. 3, illustrating various details associated with the assembly and securement of a duct body within a cavity of a receptacle, in accordance with an aspect of the present disclosure.

Referring to FIGS. 6, 7, and 8, once the base 222 is mounted to the cylinder head 148, the operator may bring forth the duct body 226 and may insert the duct body 226 into the cavity 266 of the receptacle 262. At this point, the operator may cause the rotational alignment surface 366 (or the first duct flat surface 370) to face the mouth 288 and the first receptacle flat surface 322 as the duct body 226 is brought towards the mouth 288 for entry into the cavity 266 (see FIG. 8). As the operator attempts to insert the duct body 226 into the cavity 266 of the receptacle 262, the first straight surface 392 and the second straight surface 400 of the duct body 226 may respectively contact the first top edge 284' and the second top edge 284" of the first arm 282' and the second arm 282", respectively. Thereafter, the operator pushes the duct body 226 further into the cavity 266 of the receptacle 262. As the first arm 282' and the second arm 282" are deflectable with respect to the floor portion 278, the force of the engagement between the duct body 226 and the first arm 282' and second arm 282" causes the first arm 282' and the second arm 282" to deflect and move outwards (see direction, B-B', FIG. 8), thus increasing the distance, D1, defined between the first top edge 284' and the second top edge 284", and in turn expanding and opening up the mouth 288 of the cavity 266 defined between the first top edge 284' and the second top edge 284".

Figure 9:
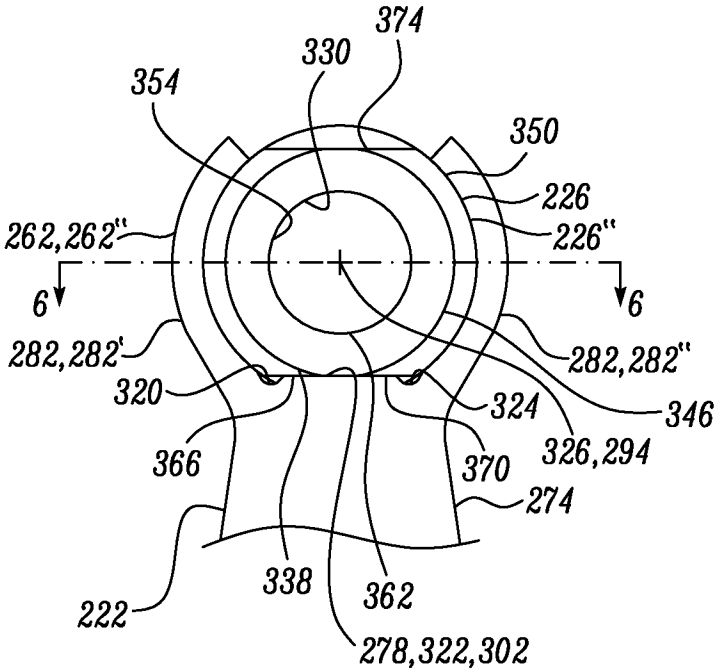
FIG. 9 is a view illustrating an assembled state of the duct body within the cavity of the one of the receptacles of the base, in accordance with an aspect of the present disclosure.

As the operator continues to push the duct body 226 into the cavity 266, the first arm 282' and the second arm 282" may further deflect and the first top edge 284' and the second top edge 284" may move further away from each other and attain a distance equivalent to the distance, D2. As soon as the distance between the first top edge 284' and the second top edge 284" equals (or minimally exceeds) the distance, D2, the duct body 226 may slide into the cavity 266 and be snapped into the cavity 266 of the receptacle 262. Given that the first duct flat surface 370 were facing the first receptacle flat surface 322 during entry, as soon as the duct body 226 is snapped and received into the cavity 266 of the receptacle 262, the first duct flat surface 370 falls into abutment with the first receptacle flat surface 322, thereby engaging the rotational alignment surface 366 of the duct body 226 with the rotational engagement surface 302 of the receptacle 262 and rotationally aligning the duct body 226 along the receptacle axis 294 of the receptacle 262. In that manner, the duct body 226 attains an assembled state with the receptacle 262 (see FIG. 9).

It may be noted that said manner of abutment of the first duct flat surface 370 with the first receptacle flat surface 322 enables an error free assembly of the duct body 226 within the cavity 266 of the receptacle 262. Once the duct body 226 is fully accommodated within the cavity 266, the duct axis 326 may fall in line with the receptacle axis 294. Further, the first top edge 284' and the second top edge 284" may return to their initial positions (see direction, C-C', FIG. 8) to define the distance, D1, therebetween, thus urging the first duct flat surface 370 to remain abutted with the first receptacle flat surface 322.

Moreover, given that the length defined by the first straight surface 392 along the duct axis 326 may be equal to the distance, E1, and a length defined by the second straight surface 400 along the duct axis 326 may be equal to the distance, E2, in such accommodation of the duct body 226 within the cavity 266 of the receptacle 262, the ridges 382 come into contact with the first lateral side edge 314' and the second lateral side edge 318' of the first arm 282' and engages and entraps the first arm 282' of the U-shaped portion 270 therebetween. Similarly, the ridges 394 come into contact with the first lateral side edge 314" and the second lateral side edge 318" of the second arm 282" and engages and entraps the second arm 282" of the U-shaped portion 270 therebetween. In so doing, the axial alignment surface 378 of the duct body 226 engages the axial engagement surface 306 of the receptacle 262 to axially align the duct body 226 along the receptacle axis 294 of the receptacle 262.

In an assembly of the duct body 226 within the cavity 266 of the receptacle 262, the first arm 282' and the second arm 282" resiliently engage a portion (e.g., the straight part 352) of the duct body 226 and secure the duct body 226 therebetween. It may also be noted that engagement of the axial alignment surface 378 with the axial engagement surface 306 further includes at least a partial capture of the first recessed portion 390 and the second recessed portion 404 of the duct body 226 into the U-shaped portion 270 of the receptacle 262. Further, it is possible for the duct body 226 to be assembled to the base 222 first before the base 222 is assembled to the flame deck surface 158 of the cylinder head 148.

As part of the assembly of the duct body 226 to the receptacle 262, the engagement of the rotational alignment surface 366 with the rotational engagement surface 302 allows the duct body 226 to be captured appropriately and correctly into the cavity 266. The first arm 282' and the second arm 282" urges the first duct flat surface 370 to remain abutted with the first receptacle flat surface 322, preventing rotation of the duct body 226 with respect to the receptacle 262 and from loosening out from the receptacle 262. Moreover, the engagement of the axial alignment surface 378 with the axial engagement surface 306 prevents axial misplacement of the duct body 226 with respect to the receptacle 262 along the receptacle axis 294 defined by the receptacle 262. In effect, owing to the rotational engagement surface 302 and the axial engagement surface 306 of the base 222 and the rotational alignment surface 366 and the axial alignment surface 378 of the duct body 226, the duct body 226 is appropriately and correctly located and oriented with respect to the receptacle 262 and thus the base 222, during assembly. An assembly of the duct body 226 with the receptacle 1200 may be understood based on the manner in which the assembly of the duct body 226 to the receptacle 262 has been discussed above.

Further, an assembly of the duct body 900 with the receptacles 928, 932, 936 may also be understood based on the manner in which the assembly of the duct body 226 to the receptacle 262 has been discussed above. During assembly of the duct body 900 with the receptacle 928, for example, the first connecting surface 912 and the third connecting surface 920 may respectively come into contact with the first top edge 972' and the second top edge 972". As the operator continues to push the duct body 900 into the cavity 986, the first arm 940' and the second arm 940" may flex and expand (e.g., see direction, B-B', applied for the receptacle 262, FIG. 8). The first depressed surface 984' and the second depressed surface 984" may ease such flexure of the first arm 940' and the second arm 940", to facilitate an entry of the duct body 900 into the cavity 986. Simultaneously, or in consequence, the first recessed section 968' and the second recessed section 968" may respectively enable the first protruded section 964' and the second protruded section 964" to flex as well (e.g., inwards into the cavity 986) relative to the first upright section 960' and the second upright section 960", helping the duct body 900 to be inserted into the cavity 986.

Once the duct body 900 is snapped and received into the cavity 986, an assembled state of the duct body 900 with the receptacle 928 is attained (see view illustrated in FIG. 10). In the assembled state, the first protruded edge 990' of the receptacle 928 contacts the second connecting surface 916 of the duct body 900 and the second protruded edge 990" of the receptacle 928 contacts the fourth connecting surface 924 of the duct body 900 to secure the duct body 900 within the cavity 986 of the receptacle 928. In some embodiments, the first protruded edge 990' of the receptacle 928 and the second protruded edge 990" of the receptacle 928 respectively define a line of contact (e.g., along the axis 994) with the second connecting surface 916 of the duct body 900 and the fourth connecting surface 924 of the duct body 900.

An assembly of the duct body 900 into the receptacles 932, 936 may remain similar to the manner of assembly of the duct body 900 into the receptacle 928. In the assembled state of the duct body 900 into the receptacles 932, 936 the first flat face 1000' of the receptacles 932, 936 contacts the second connecting surface 916 of the duct body 900 and the second flat face 1000" of the receptacles 932, 936 contacts the fourth connecting surface 924 of the duct body 900. In some embodiments, the first flat face 1000' and the second flat face 1000" respectively define a surface of contact or a plane of contact with the second connecting surface 916 and the fourth connecting surface 924.

A contact area defined by the first protruded edge 990' and the second protruded edge 990" or a contact area defined by the first flat face 1000' and the second flat face 1000" with the second connecting surface 916 and the fourth connecting surface 924 may be lesser when compared to a contact area defined between the duct body 226 and the arms 282', 282" of the receptacle 262. In so doing, a force applied by the arms 940', 940" per unit area over the duct body 900 may be greater when compared to the force applied by the arms 282', 282" on the duct body 226, enabling the arms 940', 940" to urge the first duct flat surface 370 of the duct body 900 to remain abutted with the first receptacle flat surface 322 with greater effectiveness.

It may also be noted that in the assembled state of the duct body 900 with the receptacles 928, 932, 936, the first straight surface 904 may define a first clearance, FC, with the first upright section 960' and the second straight surface 908 may define a second clearance, SC, with the second upright section 960", thereby reducing the contact area between the arms 940', 940" and the duct body 900. Also, by providing the first straight surface 904 and the second straight surface 908, the duct body 900 may be inserted in any orientation, while still maintaining the angular alignment once secured within the receptacle 928, 932, 936.

The duct bodies 226 and the receptacle 262 (or the base 222 that includes the receptacle 262) being separate entities, enables the duct bodies 226 and the base 222 to be manufactured separately, which allows desired (and complex) duct geometries (e.g., with a higher or a lower angle, A, a smaller dimension of the duct 330, the 180 degrees rounded profile of the arcuate inlet surface 358, or a higher number of duct bodies 226) to be formed, making an associated manufacturing process less complex and less tedious. Moreover, the entire duct assembly 198 need not be removed if only one or few duct bodies 226 needed service and/or repairs. In some cases, coupling techniques such as welding, brazing, or gluing, may be applied to retain the first duct flat surface 370 with the first receptacle flat surface 322, or such techniques may be applied between other portions of the duct body 226 and the receptacle 262, to immovably couple and house the duct body 226 within the cavity 266 of the receptacle 262.

Similar discussions and applicability may be contemplated for the duct body 900 and the receptacles 928, 932, 936, 1200 (and/or their corresponding bases that include the receptacles 928, 932, 936, 1200), as well. Further, it may be noted that one or more of the features associated with the duct body 226 and the receptacle 262 and/or one or more of the features associated with the variants of the duct body 226 (i.e., the duct body 900) and the receptacle (i.e., the receptacles 928, 932, 936, 1200), as have been discussed in the present disclosure, may be applied in any combination with one another.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

What is claimed is:

1. A duct assembly for a fuel injector of an engine, the duct assembly comprising:

a base configured to be coupled to a cylinder head of the engine, the base including a plurality of spaced apart receptacles, each receptacle of the plurality of spaced apart receptacles defining a cavity therein, the cavity defining a receptacle axis, a rotational engagement surface, and an axial engagement surface; and a plurality of duct bodies being correspondingly secured within cavities defined by the plurality of spaced apart receptacles, each duct body of the plurality of duct bodies defining an axis and a duct extending therethrough along the axis to provide a passage for a corresponding fuel jet discharged from the fuel injector, wherein each duct body further defining an axial alignment surface, the axial alignment surface engaging the axial engagement surface of the receptacle in which it is disposed to axially align the duct body along the receptacle axis of the corresponding receptacle.

2. The duct assembly of claim 1, wherein each duct body defines a rotational alignment surface, the rotational alignment surface engaging the rotational engagement surface of the receptacle in which it is disposed to rotationally align the duct body along the receptacle axis of the corresponding receptacle.

3. The duct assembly of claim 2, wherein each receptacle includes a U-shaped portion defining a floor portion and a pair of arms extending away from the floor portion, the floor portion and the pair of arms defining the cavity therebetween.

4. The duct assembly of claim 3, wherein:

the rotational alignment surface of each duct body comprises a first duct flat surface, and the rotational engagement surface of each receptacle comprises a first receptacle flat surface on the floor portion of each receptacle, wherein engagement of the rotational alignment surface of each duct body with the rotational engagement surface of the receptacle in which it is disposed includes an abutment of the first duct flat surface with the first receptacle flat surface of the receptacle in which it is disposed.

5. The duct assembly of claim 4, wherein each duct body comprises a second duct flat surface disposed diametrically opposite to the corresponding first duct flat surface.

6. The duct assembly of claim 3, wherein at least one arm of the pair of arms is deflectable and the pair of arms is configured to resiliently engage a portion of the corresponding duct body and secure the corresponding duct body therebetween.

7. The duct assembly of claim 6, wherein the U-shaped portion defines a groove at an interface between the floor portion and the at least one arm to relieve stress from the interface during a deflection of the at least one arm.

8. The duct assembly of claim 3, wherein:

the axial alignment surface of each duct body comprises axially spaced apart ridges along an outer surface of each duct body, and the axial engagement surface of each receptacle comprises lateral side edges of at least one arm of the pair of arms of each receptacle, the lateral side edges engaging the axially spaced apart ridges of the corresponding duct body to axially align the corresponding duct body along the receptacle axis of the receptacle in which it is disposed.

9. The duct assembly of claim 8, wherein engagement of the axial alignment surface with the axial engagement surface includes entrapment of at least a part of the U-shaped portion between the axially spaced apart ridges.

10. The duct assembly of claim 8, wherein the duct body further includes a recessed portion formed at least partially circumferentially around the duct body and defining the axially spaced apart ridges.

11. The duct assembly of claim 10, wherein engagement of the axial alignment surface with the axial engagement surface further includes at least a partial capture of the recessed portion of the duct body into the U-shaped portion of the receptacle.

12. The duct assembly of claim 8, wherein each duct body includes a first axial end and a second axial end, the duct extending from the first axial end to the second axial end and defining a arcuate inlet surface at the first axial end to receive the corresponding fuel jet from the first axial end and a sharp edged outlet at the second axial end to expel the corresponding fuel jet through the second axial end.

13. The duct assembly of claim 12, wherein the axially spaced apart ridges include a first ridge and a second ridge, the first ridge being disposed relatively proximal to the first axial end, while the second ridge being disposed relatively distal from the first axial end.

14. A fuel injection system for an engine, the fuel injection system comprising:

a fuel injector configured to discharge a plurality of fuel jets into a combustion chamber of the engine;

a duct assembly for the fuel injector, the duct assembly including:

a base configured to be coupled to a cylinder head of the engine, the base including a plurality of spaced apart receptacles, each receptacle of the plurality of spaced apart receptacles defining a cavity therein, the cavity defining a receptacle axis, a rotational engagement surface, and an axial engagement surface; and a plurality of duct bodies being correspondingly secured within cavities defined by the plurality of spaced apart receptacles, each duct body of the plurality of duct bodies defining an axis and a duct extending therethrough along the axis to provide a passage for a corresponding fuel jet discharged from the fuel injector, wherein each duct body further defining an axial alignment surface, the axial alignment surface engaging the axial engagement surface of the receptacle in which it is disposed to axially align the duct body along the receptacle axis of the corresponding receptacle.

15. The fuel injection system of claim 14, wherein each duct body defines a rotational alignment surface, the rotational alignment surface engaging the rotational engagement surface of the receptacle in which it is disposed to rotationally align the duct body along the receptacle axis of the corresponding receptacle.

16. The fuel injection system of claim 15, wherein each receptacle includes a U-shaped portion defining a floor portion and a pair of arms extending away from the floor portion, the floor portion and the pair of arms defining the cavity therebetween, wherein at least one arm of the pair of arms is deflectable and the pair of arms is configured to resiliently engage a portion of the corresponding duct body and secure the corresponding duct body therebetween, and the U-shaped portion defines a groove at an interface between the floor portion and the at least one arm to relieve stress from the interface during a deflection of the at least one arm.

17. The fuel injection system of claim 16, wherein:

the rotational alignment surface of each duct body comprises a first duct flat surface, and the rotational engagement surface of each receptacle comprises a first receptacle flat surface on the floor portion of each receptacle, wherein engagement of the rotational alignment surface of each duct body with the rotational engagement surface of the receptacle in which it is disposed includes an abutment of the first duct flat surface with the first receptacle flat surface of the receptacle in which it is disposed.

18. The fuel injection system of claim 16, wherein:

the axial alignment surface of each duct body comprises axially spaced apart ridges along an outer surface of each duct body, and the axial engagement surface of each receptacle comprises lateral side edges of at least one arm of the pair of arms of each receptacle, the lateral side edges engaging the axially spaced apart ridges of the corresponding duct body to axially align the corresponding duct body along the receptacle axis of the receptacle in which it is disposed.

19. The fuel injection system of claim 18, wherein the duct body further includes a recessed portion formed at least partially circumferentially around the duct body and defining the axially spaced apart ridges.

20. An engine, comprising:

a cylinder defining a bore;

a piston slidably disposed within the bore and defining a piston crown;

a cylinder head coupled to the cylinder and defining a flame deck surface;

a combustion chamber defined between the flame deck surface and the piston crown;

a fuel injector configured to discharge a plurality of fuel jets into the combustion chamber;

a duct assembly for the fuel injector, the duct assembly including:

a base coupled to the cylinder head, the base including a plurality of spaced apart receptacles, each receptacle of the plurality of spaced apart receptacles defining a cavity therein, the cavity defining a receptacle axis, a rotational engagement surface, and an axial engagement surface; and a plurality of duct bodies being correspondingly secured within cavities defined by the plurality of spaced apart receptacles, each duct body of the plurality of duct bodies defining an axis and a duct extending therethrough along the axis to provide a passage for a corresponding fuel jet discharged from the fuel injector, wherein each duct body further defining an axial alignment surface, the axial alignment surface engaging the axial engagement surface of the receptacle in which it is disposed to axially align the duct body along the receptacle axis of the corresponding receptacle.

* * * * *